United States Patent [19]

Van Rosendal et al.

[11] Patent Number: 4,718,220

[45] Date of Patent: Jan. 12, 1988

[54] DEVICE FOR APPLYING A CLOSING STRIP AND A CASSETTE THEREFOR

[76] Inventors: Nicolaas Van Rosendal, No. 244 Berfloweg, 7553 JW Hengelo; Ary G. Dirkzwager, No. 203 Helmerstraat, 7546 PD Enschede, both of Netherlands

[21] Appl. No.: 808,733

[22] Filed: Dec. 13, 1985

[30] Foreign Application Priority Data

Jan. 9, 1985 [NL] Netherlands ..... 8500050

[51] Int. Cl.[4] ..... B65B 67/06

[52] U.S. Cl. ..... 53/583; 53/139.3; 242/55.53

[58] Field of Search ..... 53/583, 139.3, 138 A; 242/55.53, 71.1

[56] References Cited

U.S. PATENT DOCUMENTS

| | | | |
|---|---|---|---|
| 3,403,869 | 10/1968 | Marchisen et al. | 242/55.53 |
| 3,729,896 | 5/1973 | Lehmann | 53/583 |
| 4,537,005 | 8/1985 | Hoyland | 53/583 |

FOREIGN PATENT DOCUMENTS

| | | | |
|---|---|---|---|
| 7810993 | 5/1980 | Netherlands | 53/583 |
| 8303453 | 4/1985 | Netherlands | 53/583 |
| 8501266 | 3/1985 | PCT Int'l Appl. | 53/583 |
| 1530879 | 11/1978 | United Kingdom | 53/583 |
| 401590 | 3/1974 | U.S.S.R. | 53/583 |

*Primary Examiner*—Robert L. Spruill
*Assistant Examiner*—Donald R. Studebaker
*Attorney, Agent, or Firm*—John P. Snyder

[57] ABSTRACT

Device for applying a closing strip, comprising: a housing provided with a channel; a feed for closing strip tape emerging into said channel; a rotor mounted for rotation on said housing and provided with blades projecting into said channel; and cutting means located downstream from said rotor for cutting off the formed closing strip from the closing strip tape, characterized by a member located between said rotor and cutting means and extending into said channel for forming the closing strip during the guiding of the closing strip tape thereover.

Preferably said member is an edge positioned transversely on said channel, and forms a part of the housing. If the device comprises further a feed for tape form material emerging into said channel and a magazine therefor, said feed for tape form material and its magazine are, preferably accommodated in a separate cassette.

26 Claims, 13 Drawing Figures

FIG. 3
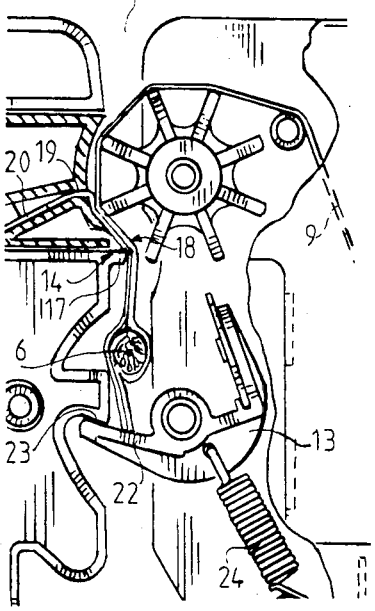
FIG 4
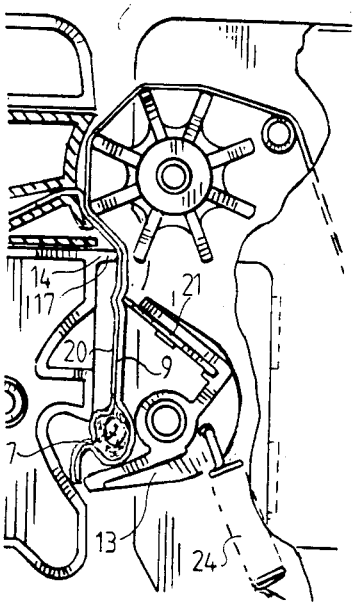
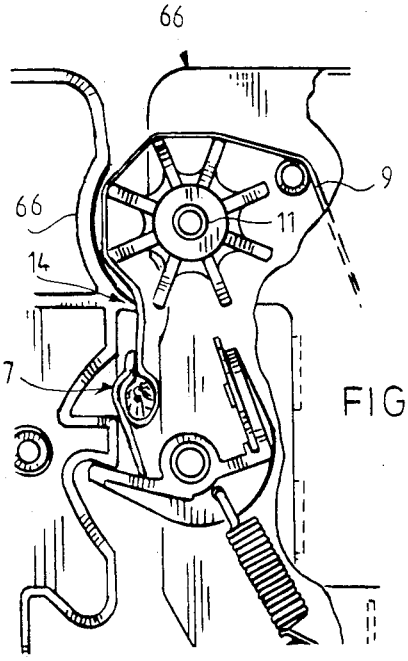
FIG.13

FIG. 5
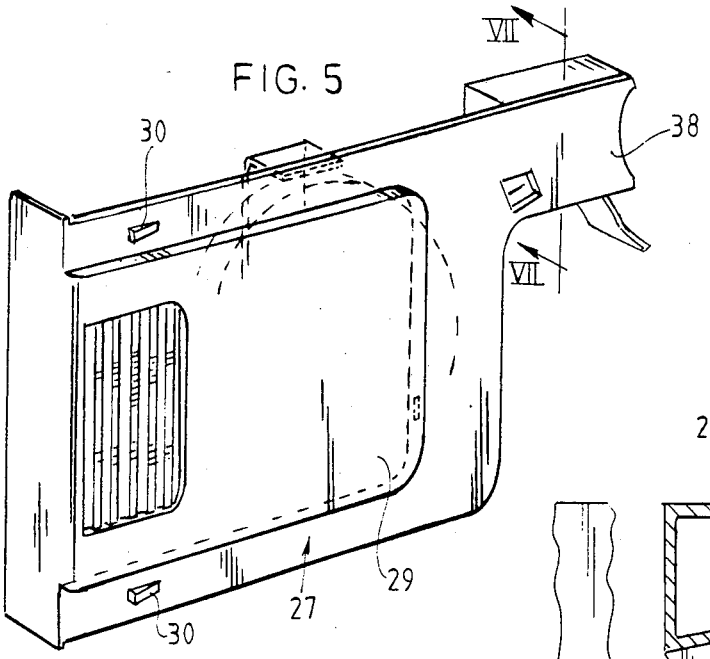
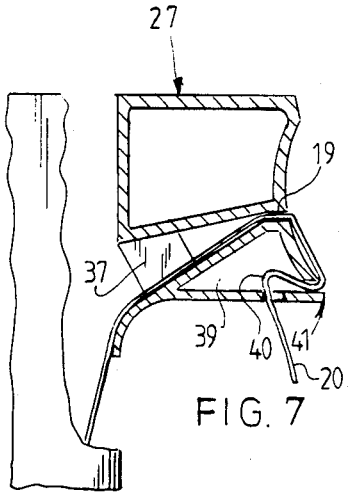
FIG. 7
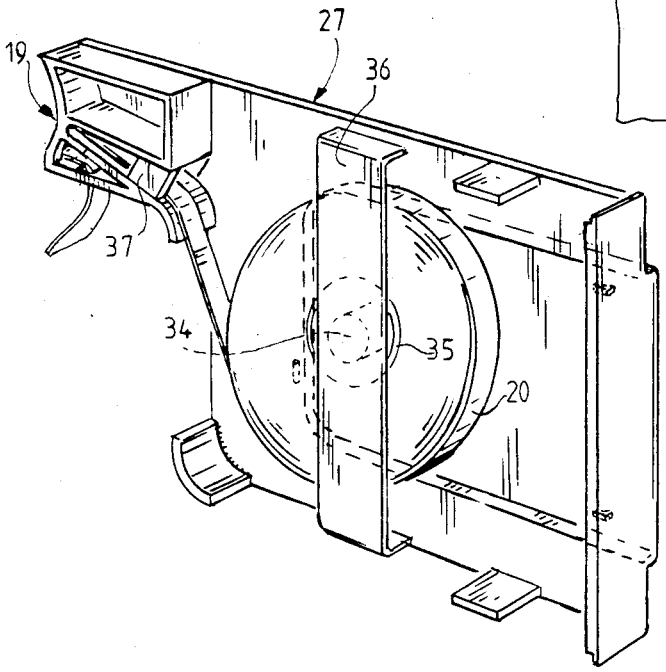
FIG. 6

DEVICE FOR APPLYING A CLOSING STRIP AND A CASSETTE THEREFOR

The present invention relates to a device for applying a closing strip, comprising: a housing provided with a channel; a feed for closing strip tape emerging into said channel; a rotor mounted for rotation on the housing and provided with blades projecting into the channel; and cutting means located downstream from the rotor for cutting off the formed closing strip from the closing strip tape.

With this known device a closing strip can be applied for example around an envelope, a plastic bag for example. For this purpose said known device is further provided with an element co-operating with the rotor, so that on the one hand the closing strip tape is applied tightly around the envelope and on the other hand the parts of the closing strip tape forming the free ends of the closing strip are stuck against one another. In the case that a releasable closing strip is manufactured, the said element serves to press a paper strip against these parts. Known embodiments of this element are a spring blade and a pivotable bracket.

The invention has for its object to improve the known device in that the use of this known, separate element can be dispensed with, while an adequate closing strip is formed. This is achieved according to the invention because the device features a member located between the rotor and the cutting means, which member extends into the channel for forming the closing strip during the guiding of the closing strip tape thereover. This member according to the invention interrupts the substantially straight path of movement of the closing strip tape so that same is pulled tight and adhesive parts of same adjacent to one another are stuck together. Surprisingly it has been found also that the operation of applying the closing strip proceeds more quickly and fluently, while less force is thereby required.

In a first embodiment the member is an edge positioned transversely on the channel, said edge preferably forming part of the housing of the device. In other embodiments it is only necessary that the member extends into the channel over at least a part of the width of the closing strip tape, thereby interrupting its path.

If a releasable closing strip is applied around an envelope with the device, the latter further comprises a feed for tape form material emerging into the channel and a magazine therefor. It is advantageous if the feed for the tape form material and its magazine are accomodated in a separate cassette.

In a second embodiment of the member according to the invention, said member is arranged on the cassette.

In order to ensure a direct and good supply of paper when replacing cassettes, it is recommended that the latter is provided with a chamber in which a part of the tape form material can be accommodated.

If a part of the material provided with the closing strip, for example an envelope, must be removed, the device features other cutting means, arranged downstream from the cutting means, located on the channel and fitted with finger protection, for cutting material provided with closing strip. This finger protection enlarges the application of the device according to the invention for household use. A prefered embodiment of the device according to the invention features means for securing a ballast in the housing, so that this ballast does not rattle during use, thereby causing possible damage in the interior.

Especially in the case of industrial use of the device according to the invention, separate, replaceable elements thereof must be accessible for maintenance or replacement. To this end the device features a cover arranged in the housing which gives access to the cutting means for cutting the closing strip tape.

A well functioning device is obtained if it features locking means acting on the rotor, which means lock the rotor against a rotation whereby the blades present in the channel move towards the feed for closing strip tape, so that closing strip tape is guided continuously over the rotor blades and through use of the device an adequate closing strip is always formed. In a preferred embodiment, the locking means comprise co-operating toothings arranged on the housing and on the rotor and spring means pushing these toothings towards one another.

Another aspect of the invention relates to a cassette for use with the device according to the invention.

Mentioned and other characteristics will be made apparent on the basis of a number of non-limitative embodiments of the device according to the invention given by way of example, with reference to the appended drawing. In the drawing:

FIGS. 3, 4 and 13 show respectively detail III, IV and XIII from FIG. 2 of respectively two successive operating positions and another embodiment of the device;

FIGS. 5 and 6 show respectively a perspective front and rear view of the cassette;

FIG. 7 shows a section along the line VII—VII from FIG. 5;

Figure 1:
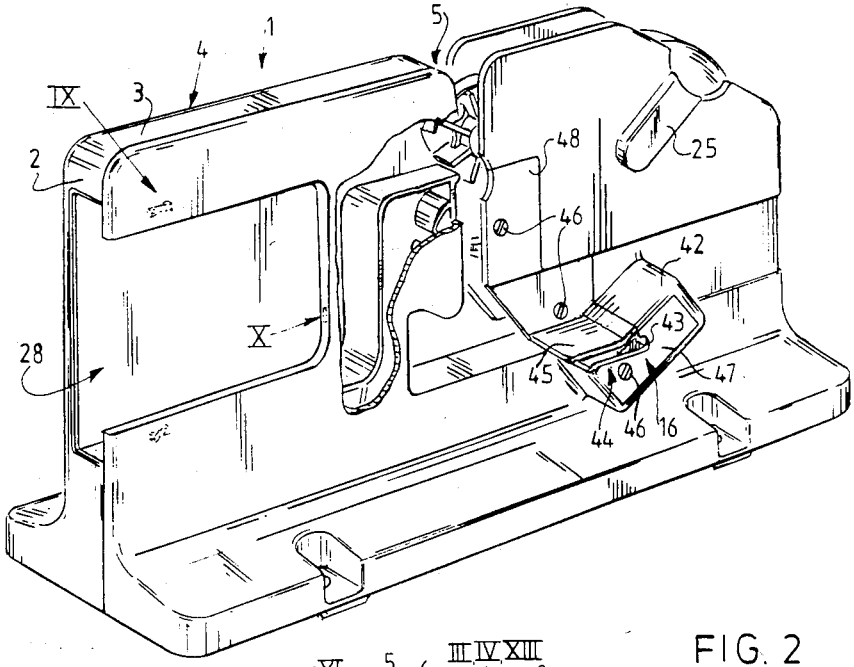
FIG. 1 shows a perspective view of the device for applying a closing strip, where the cassette is removed.

FIG. 1 shows the device 1 according to the invention. The device comprises a housing 4 constructed from two half-housings 2 and 3, the housing being provided with a channel 5. In the path of movement for applying a closing strip 7 around an envelope 6, there are situated by the channel 5 a feed 8 for closing strip tape 9 emerging into the channel 5, which tape is provided on the side 10 with an adhesive layer, a rotor 11 mounted for rotation on the housing 4, which rotor is provided with blades 12 to project into the channel 5, and cutting means 13 located downstream from rotor 11. Between rotor 11 and cutting means 13 is arranged the member 14, extending into the channel 5. Finally, other cutting means 16, with which a part of the envelope 6 can be cut off, are situated at the dead-end 15 of channel 5. The housing includes a pair of spaced walls 70 and 71 which have first edges 72 and 73 thereon respectively which define one side of channel 5. Walls 70 and 71 also include second edges 74 and 75 respectively which define the opposite side of the channel. Edge 72 has a concave recess 76 formed therein disposed opposite member 14.

Edge 73 has a similar concave recess 77 formed therein disposed opposite member 14.

The operation of the member 14 according to the invention, which in the embodiment shown is an edge 17 positioned transversely on the channel 5, can be clearly deduced from FIGS. 3 and 4. In FIG. 3 the envelope 6 with the closing strip tape 9 already closed around it has passed the edge 17. The edge 17 ensures that at the point of the said edge 17 a deflection 18 occurs in the closing strip tape 9 and the other tape form material, for example paper 20, supplied by the feed 19, so that materials 9 and 20 are thereby pressed together at the point of edge 17 and adhere to one another.

Figure 2:
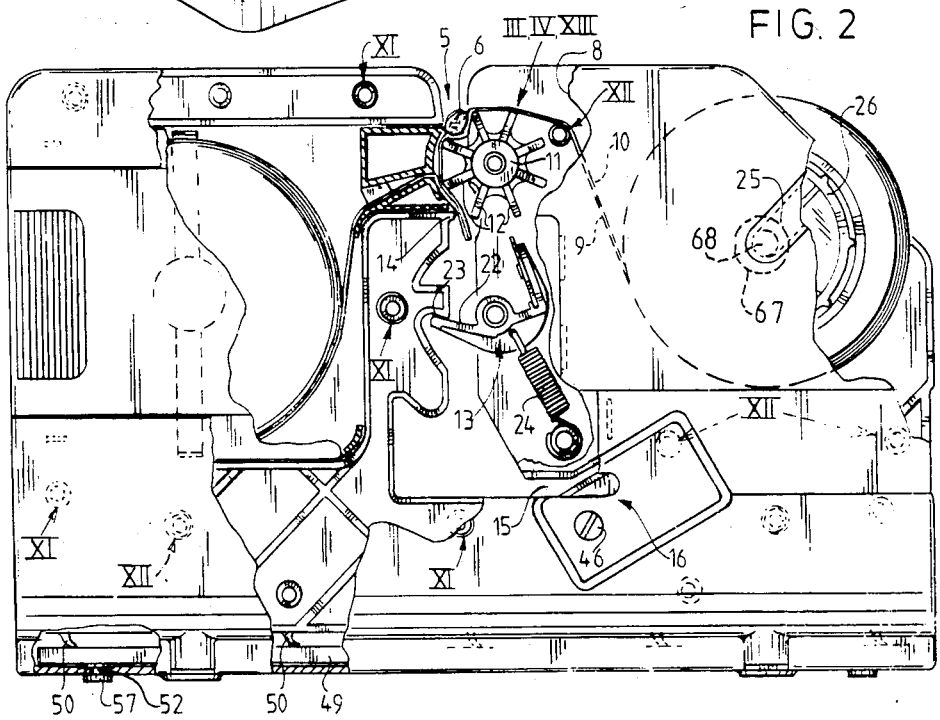
FIG. 2 shows a partly cut away and broken away front view of the device shown in FIG. 1.

FIG. 4 further clearly shows that with energizing of the cutting means 13 the materials 9 and 20 adhered to one another are stretched tightly so that the cut is actually made with the aid of blade 21, with the result that energizing of these cutting means requires less force and a smooth line of cut is formed. Under the influence of spring 24 the cutting means 13 are returned to the position shown in FIG. 2, whereby the control arm 22 comes to rest against a stop 23 formed in half-housing 2.

The device 1 according to the invention comprises only three parts separate from housing 4, namely the rotor 11, cutting means 13 and their accessory spring 24.

The closing strip tape 9 is supplied from a rotatable reel 26 provided with closing strip tape 9 accommodated in a guide 25. A rubber ring 67 is arranged around a hub 68 of the reel 26, whereby said reel 26 makes frictional contact with guide 25. In this way free rotation and undesired unwinding are avoided.

Figure 9:
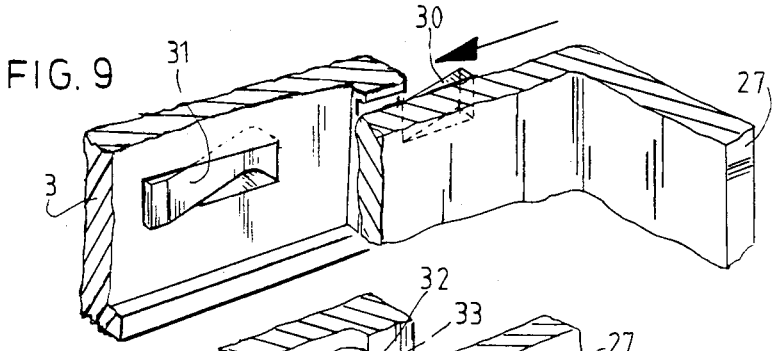
FIGS. 9 and 10 show the locking of the cassette on the housing of the device at respectively the point of arrows IX and X from FIG. 1.
Figure 10:
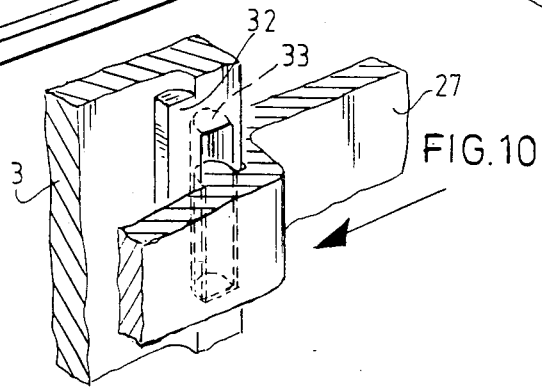

As FIG. 5, 6 and 7 clearly show, the paper feed 19 for paper 20 forms part of a cassette 27 which can be inserted into the recess 28 (see FIG. 1). The upright part 29 of cassette 27 forms in addition part of the wall of half-housing 3. With the aid of co-operating projections 30 and 31 (FIGS. 5 and 9) and the co-operating recess 32 and projection 33 (FIG. 10), the cassette 27 is locked against undesired displacement after insertion into recess 28.

A reel 35 with paper tape 20 is arranged for rotation around a hub 34 formed on cassette 27. A bracket 36 is firmly attached to hub 34, whereby on the one hand undesired unwinding of the reel is prevented and on the other a new reel 35 can be arranged on hub 34 without breaking off bracket 36.

The paper 20 is guided in the direction of the paper feed 19 between two walls 37 and 38 arranged on either side of the paper, so that undesired sideways displacement is avoided. In addition cassette 27 is provided with a chamber 39 located below paper feed 19, in which chamber is contained a fold 40 in the paper 20. In this way, after arranging cassette 27 in the device 1, the paper is supplied in a form such that an adequate releasable closing strip can be formed directly with the closing strip tape 9. Although in the device 1 the member 14 according to the invention is arranged on housing 4, it is quite possible for this member to be arranged at the point of arrow 41 on cassette 27 which forms part of device 1, while still preserving its characteristic qualities.

The cutting means 16 comprise a knife blade 43 accomodated in a chamber 42. A spacing edge 45 of a cover 47 connects onto the chamber 42 as finger protection 44. In this way knife blade 43 is inaccessible to fingers, especially a child's fingers, while the envelope can reach knife blade 43 for the performing of the cutting process. The chamber is accessible via a cover 47 which is attached to it with the aid of screws 46. It will be noted that cover 48 forms part of the housing and an edge of the cover defines the lower part of edge 73 and also defines a portion of the concave recess 77 formed in the edge.

The cutting means 13 are also accessible for replacement or maintenance via a disconnectable cover 48.

A ballast 49 in the form of a metal strip is accomodated in the lower part of device 1. With the aid of resilient plastic shark teeth 50 formed on half-housing 2, ballast 49 is pressed against H-shaped rubber strips 51, which strips are inserted into recesses arranged in both half-housings 2 and 3. The device 1 supports on a base via these strips 51.

Figure 8:
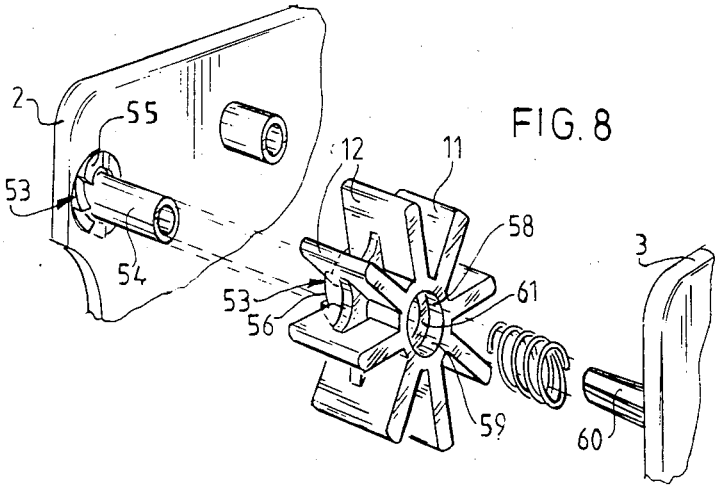
FIG. 8 shows an exploded perspective partial view of the rotor with the locking means according to the invention.

FIG. 8 shows locking means 53 acting on rotor 11 which lock rotor 11 against a rotation whereby the blades 12 found in channel 5 move towards the feed 8 for closing strip tape, in the drawing a clockwise rotation. Locking means 53 comprise toothing 55 arranged on the housing around a bush 54 and tooting 56 arranged on rotor 11 co-operating with toothing 55 and a spiral spring 57 which pushes rotor 11 towards tooting 55. Rotor 11 is freely rotatable around bush 54 while spring 5 is accomodate in an annular space 58 bounded in radial direction by a bore 59 and a projection 60 attached to half-housing 3, projection 60 being accomodated in bush 54, and bounded in axial direction by half-housing 3 and a narrowed edge 61 in bore 59.

Figure 11:
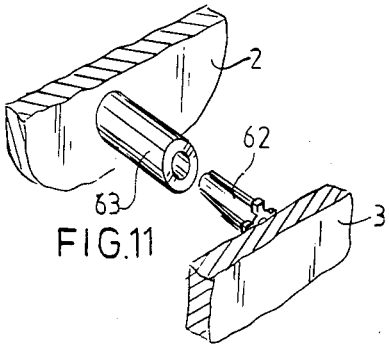
FIGS. 11 and 12 show the attachment of the half-housings forming the housing at respectively the point of arrows XI and XII from FIG. 2.
Figure 12:
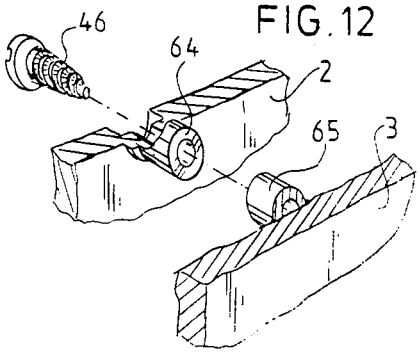

Finally FIGS. 11 and 12 show two applied forms of attachment for both half-housings 2 and 3, whereby in the case of FIG. 11 a clamping connection is formd using male and female elements 62 and 63, while in FIG. 12 both half-housings are pulled towards one another with the aid of a screw 46 guided into bush 64 and self-tapping into bush 65.

Finally FIG. 13 shows a second embodiment of device 1 according to the invention, whereby a closing strip 7 is formed only from a closing strip tape 9. In this case paper feed 19 is omitted and the wall 66 located opposite rotor 11 has a complementary curved shape. The same object is attained in this case also with the aid of member 14, although no releasable closing strip is formed.

We claim:

1. Device for applying a closing strip wrapped around a portion of an envelope such as a plastic bag, comprising a housing provided with a channel through which the portion of the envelope is guided during operation; a rotor mounted for rotation on said housing and provided with blades projecting into said channel and defining pockets between successive blades into one of which the portion of the envelope is received as the portion is introduced into the channel; a feed for adhesive closing strip tape emerging into said channel above the rotor and having an adhesive side facing the channel so that the portion of the envelope adheres thereto in partially wrapped relation around the portion of the envelope as the portion of the envelope is received in a pocket of the rotor; cutting means located downstream from said rotor for cutting off a closing strip wrapped around the portion of the envelope from the closing strip tape, and a member located between said rotor and cutting means and extending into said channel from that side thereof opposite the rotor, said member being rigid relative to said housing and defining a deviation in said channel between the rotor and the cutting means, the closing strip being movable over said member and deflected thereby as the partially wrapped portion of the envelope emerges from the pocket of the rotor to form the closing strip wrapped around the portion of the envelope.

2. Device as claimed in claim 1, wherein said member is an edge positioned transversely to said channel.

3. Device as claimed in claim 2, wherein said edge forms part of the housing.

4. Device as claimed in claim 1 further comprising a feed means for feeding nonadhesive tape form material into said channel above the member but below the pocket in which the portion of the envelope is received and the nonadhesive tape form material emerging into the channel from that side opposite the side thereof into which the adhesive strip tape emerges, a magazine for the feed means, said feed means for the tape form material and its magazine being accommodated in a separate cassette.

5. Device as claimed in claim 4, wherein said cassette forms part of the housing.

6. Device as claimed in claim 4 wherein said member is arranged on said cassette.

7. Device as claimed in claim 4 wherein said cassette is provided with a chamber in which part of the tape form material can be accommodated.

8. Device as claimed in claim 1 including other cutting means arranged downstream from said cutting means first mentiond, located in said channel and provided with finger protection, for cutting the material provided with said closing strip.

9. Device as claimed in claim 1 including means for securing a ballast in said housing.

10. Device as claimed in claim 1 including a cover arranged in said housing giving access to said cutting means for the cutting of closing strip tape.

11. Device as claimed in claim 1 including locking means acting on said rotor, locking same against a rotation whereby the blades present in said channel move towards said feed for closing strip tape.

12. Device as claimed in claim 11, wherein said locking means comprise co-operating toothings arranged on said housing and on said rotor and spring means pushing said toothings towards one another.

13. A device for applying a closing strip wrapped around an item such as a bag comprising a housing having spaced walls, said walls each including first edges defining one side of a channel through said housing, said walls each including second edges defining the opposite side of said channel, said channel receiving an item for movement therealong during operation, a rotor rotatably supported by said housing and including spaced blades projecting into said channel and projecting beyond said first edges and toward said second edges, adjacent blades of said rotor defining pockets for receiving items therein, means for feeding closing strip tape onto the periphery of said rotor blades, said tape having an adhesive side and an opposite nonadhesive side which contacts said blades so that the adhesive side adheres in partially wrapped relation around the item as the item is received in a pocket of the rotor, a rigid member which is rigidly supported relative to said housing and extending into said channel beyond said second edges and toward said first edges and defining a rigid protuberance beyond the second edges, said first edges each having a concave recess formed therein disposed opposite the protuberance defined by said member to prevent constriction of the channel thereat, the closing strip tape being movable over said member and deflected thereby during operation as the partially wrapped portion of the envelope emerges from the pocket of the rotor to form a closing strip wrapped around the item, and cutting means movably supported by said housing below said rotor and said member, said cutting means being movable across said channel for cutting off a formed closing strip from the closing strip tape.

14. A device as defined in claim 13 wherein said member is formed integral with said housing.

15. A device as defined in claim 13 including means for feeding nonadhesive tape form material into said channel, said last-mentioned feed means being disposed in a separate cassette.

16. A device as defined in claim 15 wherein said member is integral with said cassette.

17. A device as defined in claim 15 wherein said cassette includes a chamber receiving a portion of the tape form material.

18. A device as defined in claim 13 including further cutting means supported by said housing below said first-mentioned cutting means for cutting the material provided with the closing strip, said further cutting means being located in said channel and finger protection means disposed adjacent said further cutting means.

19. A device as defined in claim 13 including locking means for locking the rotor against rotation in a direction toward the closing strip tape feed means.

20. A device as defined in claim 19 wherein said locking means comprises cooperating toothings on said housing and on said rotor, and spring means biasing said toothings into engagement with one another.

21. A device for applying a closing strip to an item such as a bag comprising a housing having spaced walls defining a channel through said housing, said channel receiving at item for movement therealong during operation, a rotor rotatably supported by said housing and including spaced blades projecting into said channel, adjacent blades of said rotor defining pockets for receiving items therein, means for feeding closing strip tape onto the periphery of said rotor blades, said tape having an adhesive side and an opposite nonadhesive side which contacts said blades so that the closing strip tapes adheres to and wraps partially around the item as the item is received in a pocket of the rotor, a rigid member which is rigid relative to said housing and extending into said channel to define a rigid protuberance below the rotor, means for feeding nonadhesive tape form material into said channel toward the center of said rotor and into engagement with the adhesive side of said closing strip tape, said last-mentioned feed means being supported on said housing in fixed relationship to said rotor, the closing strip tape and the tape form material being movable over said member and deflected thereby to complete the wrapping of a releasable closing strip around the item, and cutting means movably supported by said housing below said rotor and said member, said cutting means being movable across said channel for cutting off a formed releasable closing strip from the closing strip tape and the tape form material.

22. A device as defined in claim 21 wherein said last-mentioned feed means is supported in a separate cassette.

23. A device as defined in claim 22 wherein said cassette forms part of the housing.

24. A device as defined in claim 22 wherein said member is formed integral with said cassette.

25. A device as defined in claim 22 wherein said cassette includes a chamber for receiving a portion of the tape form material.

26. A device as defined in claim 21 including further cutting means supported by said housing below said first-mentioned cutting means for cutting the material provided with the closing strip, said further cutting means being located in said channel, and finger protection means disposed adjacent said further cutting means.

* * * * *